US009732490B2

(12) United States Patent
Katahira et al.

(10) Patent No.: US 9,732,490 B2
(45) Date of Patent: Aug. 15, 2017

(54) SNOW REMOVAL BRUSH, VEHICLE, COMBINATION VEHICLE, AND TRACK TRANSPORTATION SYSTEM

(71) Applicant: MITSUBISHI HEAVY INDUSTRIES, LTD., Tokyo (JP)

(72) Inventors: Kousuke Katahira, Tokyo (JP); So Tamura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 216 days.

(21) Appl. No.: 14/829,212

(22) Filed: Aug. 18, 2015

(65) Prior Publication Data

US 2016/0060835 A1 Mar. 3, 2016

(30) Foreign Application Priority Data

Aug. 26, 2014 (JP) ..... 2014-171595

(51) Int. Cl.
*E01H 8/00* (2006.01)
*E01H 8/06* (2006.01)
*E01H 5/09* (2006.01)

(52) U.S. Cl.
CPC ..... *E01H 8/06* (2013.01); *E01H 5/092* (2013.01)

(58) Field of Classification Search
CPC ..... E01H 8/06; E01H 5/092
See application file for complete search history.

(56) References Cited

U.S. PATENT DOCUMENTS 1,438,111 A * 12/1922 Hawley ..... E01H 8/06 37/213
1,469,210 A * 10/1923 Candee ..... E01H 8/06 318/103
2,318,127 A * 5/1943 Stewart ..... E01H 8/06 37/211
3,034,236 A * 5/1962 Pyke ..... E01H 8/06 104/279
3,249,211 A * 5/1966 Gray ..... B65G 45/10 104/279
3,305,949 A * 2/1967 Holley ..... E01H 8/06 172/96
3,886,675 A * 6/1975 Maisonneuve ..... E01H 8/06 15/54
4,151,663 A * 5/1979 Schmidt ..... E01H 8/06 37/211

(Continued)

FOREIGN PATENT DOCUMENTS

JP H05-033311 A 2/1993
JP 2003-268741 A 9/2003
JP 2010-241312 A 10/2010

*Primary Examiner* — Jason C Smith
(74) *Attorney, Agent, or Firm* — Manabu Kanesaka; Benjamin Hauptman; Kenneth Berner

(57) ABSTRACT

A snow removal brush includes a brush rotary shaft that is disposed on each of opposite lateral surfaces of a vehicle body traveling along a track and in a vehicle width direction of the vehicle body and is supported by the vehicle body to be rotatable about an axis extending in a direction intersecting a track surface of the track, and a brush part that protrudes from an outer circumferential surface of the brush rotary shaft to a radial outer side. The brush part is formed to come into contact with trolley wires provided for the track and supplying electricity to the vehicle body.

16 Claims, 5 Drawing Sheets

(56) References Cited

U.S. PATENT DOCUMENTS

| | | | | | |
|---|---|---|---|---|---|
| 4,354,320 | A * | 10/1982 | Schmidt | E01H 8/06 | 172/667 |
| 4,416,367 | A * | 11/1983 | Easton | B65G 45/18 | 104/279 |
| 4,760,657 | A * | 8/1988 | Ganzmann | E01H 5/092 | 15/82 |
| 2003/0110665 | A1* | 6/2003 | Mathison | E01H 8/06 | 37/198 |
| 2003/0230008 | A1* | 12/2003 | Verseef | E01H 5/092 | 37/208 |
| 2010/0258026 | A1* | 10/2010 | Kanemori | E01H 8/00 | 104/279 |
| 2012/0222580 | A1* | 9/2012 | Grammatis | E01H 8/06 | 104/279 |
| 2014/0259476 | A1* | 9/2014 | Amin | E01H 1/056 | 15/82 |
| 2015/0033589 | A1* | 2/2015 | McAdam | E01H 5/06 | 37/231 |
| 2015/0047232 | A1* | 2/2015 | Kassander | E01H 5/09 | 37/259 |
| 2016/0060835 | A1* | 3/2016 | Katahira | E01H 5/092 | 104/279 |
| 2016/0069033 | A1* | 3/2016 | Katahira | E01H 5/092 | 104/279 |
| 2016/0201279 | A1* | 7/2016 | Wuillemin | E01H 1/0818 | 37/197 |
| 2016/0201280 | A1* | 7/2016 | Katahira | E01H 5/061 | 37/218 |
| 2016/0230787 | A1* | 8/2016 | Wagner | F15B 21/042 | |
| 2016/0369467 | A1* | 12/2016 | Rogers | E01H 5/102 | |
| 2017/0129506 | A1* | 5/2017 | Ohata | B61D 49/00 | |

* cited by examiner

SNOW REMOVAL BRUSH, VEHICLE, COMBINATION VEHICLE, AND TRACK TRANSPORTATION SYSTEM

BACKGROUND OF THE INVENTION

Field of the Invention

The present invention relates to a snow removal brush, a vehicle, a combination vehicle, and a track transportation system.

Priority is claimed on Japanese Patent Application No. 2014-171595, filed Aug. 26, 2014, the content of which is incorporated herein by reference.

Description of Related Art

As a new means of transportation other than a bus or a railway, a track transportation system traveling on a track using running wheels made of, for instance, rubber tires is known. Such a track transportation system is generally referred to as a new transportation system or an automated people mover (APM).

A vehicle employed in this track transportation system is equipped with, for instance, power collection parts provided for a lateral portion thereof, and a guide wheel installed in together with the power collection parts. Trolley wires configured to supply the vehicle with power via the power collection parts and a guide rail with which the guide wheel comes into contact to thereby guide the vehicle in a running direction are provided on the track along which the vehicle travels. For this reason, the vehicle of the track transportation system travels along the guide rail while the power is supplied by bringing the power collection parts into contact with the trolley wires. The vehicle of the track transportation system is often automatically operated unattended, and there is a risk of snow that has accumulated from a snowfall forming an obstacle in the way of traffic.

To remove such snow, for instance, a device for removing obstacles on a track for a guide rail type vehicle is disclosed in Japanese Unexamined Patent Application, First Publication No. 2010-241312, and is capable of removing the obstacles on the track such as snow or foreign materials which are on the track surface of the track. To be specific, the device for removing obstacles on a track for a guide rail type vehicle, which is disclosed in Japanese Unexamined Patent Application, First Publication No. 2010-241312, is equipped with frames that are provided in front of wheels in a running direction, and lifting units that are mounted on the frames and raise or lower brush holders holding removal brushes for the obstacles on the track. The device for removing obstacles on a track for a guide rail type vehicle removes the obstacles on the track by pressing the brush holders downward using the lifting units and bringing the removal brushes into contact with the track surface.

Incidentally, when it snows, snow accumulates on the track surface as well as the trolley wires.

However, the device described above in Japanese Unexamined Patent Application, First Publication No. 2010-241312 cannot remove the snow that has accumulated on the trolley wires.

SUMMARY OF THE INVENTION

The present invention provides a snow removal brush, a vehicle, a combination vehicle, and a track transportation system, which are capable of easily removing snow that has accumulated on trolley wires.

In a first aspect of the present invention, a snow removal brush includes a brush rotary shaft that is disposed on each of opposite lateral surfaces of a vehicle body traveling along a track and in a vehicle width direction of the vehicle body and is supported by the vehicle body to be rotatable about an axis extending in a direction intersecting a track surface of the track, and a brush part that protrudes from an outer circumferential surface of the brush rotary shaft to a radial outer side. The brush part is formed to come into contact with trolley wires provided for the track and supplying electricity to the vehicle body.

According to this constitution, the vehicle body travels along the track. Thereby, the brush part provided on each of the opposite lateral surfaces of the vehicle body in the vehicle width direction comes into contact with the trolley wires. At this time, the brush rotary shaft can be rotated about the axis extending in a direction intersecting the track surface. For this reason, even when snow accumulates on the trolley wires from snowfall, the brush part protruding from the brush rotary shaft to the radial outer side is rotated about the axis along with the brush rotary shaft while coming into contact with the trolley wires. As a result, the snow on the trolley wires can be brushed away. Thereby, the snow that has accumulated on the trolley wires can be easily removed merely by the vehicle body traveling along the track.

Also, in the snow removal brush, the brush part may be provided on a spiral region formed on the outer circumferential surface of the brush rotary shaft to be directed to one side in an axis direction in which the axis extends with the approach to one side in the circumferential direction of the brush rotary shaft.

According to this constitution, the brush part can come into oblique contact with the trolley wires.

For this reason, when the vehicle body travels and the brush rotary shaft is rotated, the snow heaped on the trolley wires can be brushed away to be scraped out by the brush part. Thereby, the snow that has accumulated on the trolley wires can be efficiently removed.

Also, the snow removal brush may include an oscillation support portion that oscillatably supports the brush rotary shaft in a running direction in which the vehicle body travels in a state in which the brush part is in contact with the trolley wires.

According to this constitution, the brush rotary shaft can be inclined with high precision merely by the vehicle body traveling. The brush rotary shaft can be inclined with high precision in association with the traveling of the vehicle body. Thereby, the brush part can be obliquely inclined with respect to the trolley wires, and brought into contact with the trolley wires. As a result, the brush part can be rotated while being brought into contact with the trolley wires in a state in which it is obliquely inclined with respect to the trolley wires, and the snow that has accumulated on the trolley wires can be more efficiently scraped and brushed away. Thereby, the snow that has accumulated on the trolley wires can be easily removed in a more efficient way.

Also, the snow removal brush may include a rotation drive part that rotates and drives the brush rotary shaft about the axis.

According to this constitution, the brush rotary shaft is rotated by the rotation drive part. Thereby, the brush rotary shaft can be stably rotated. For this reason, it is possible to bring the brush part into contact with the trolley wires while stably maintaining the rotating state. Thereby, the snow that has accumulated on the trolley wires can be stably removed.

Also, the snow removal brush may include a rotation control part that adjusts and controls rotation of the brush rotary shaft rotated by the rotation drive part.

According to this constitution, the rotation of the brush rotary shaft rotated by the rotation drive part is adjusted by the rotation control part. Thereby, it is possible to rotate the brush rotary shaft depending on a kind or amount of falling snow. For this reason, it is possible to adequately bring the brush part into contact with the trolley wires depending on the kind or amount of the snow. Therefore, the snow that has accumulated on the trolley wires can be even more efficiently removed.

Also, in a second aspect of the present invention, a vehicle includes the above snow removal brush.

Also, in a third aspect of the present invention, a combination vehicle is connected to include at least one of the vehicles.

According to this constitution, an influence caused by the snowfall can be reduced, and the vehicle can be stably operated.

Also, in a fourth aspect of the present invention, a track transportation system includes the above vehicle, and the track which has the trolley wires and along which the vehicle body of the vehicle travels.

According to the present invention, the brush part is brought into contact with the trolley wires while being rotated, and thereby the snow that has accumulated on the trolley wires can be easily removed.

DETAILED DESCRIPTION OF THE INVENTION

First Embodiment

Figure 2:
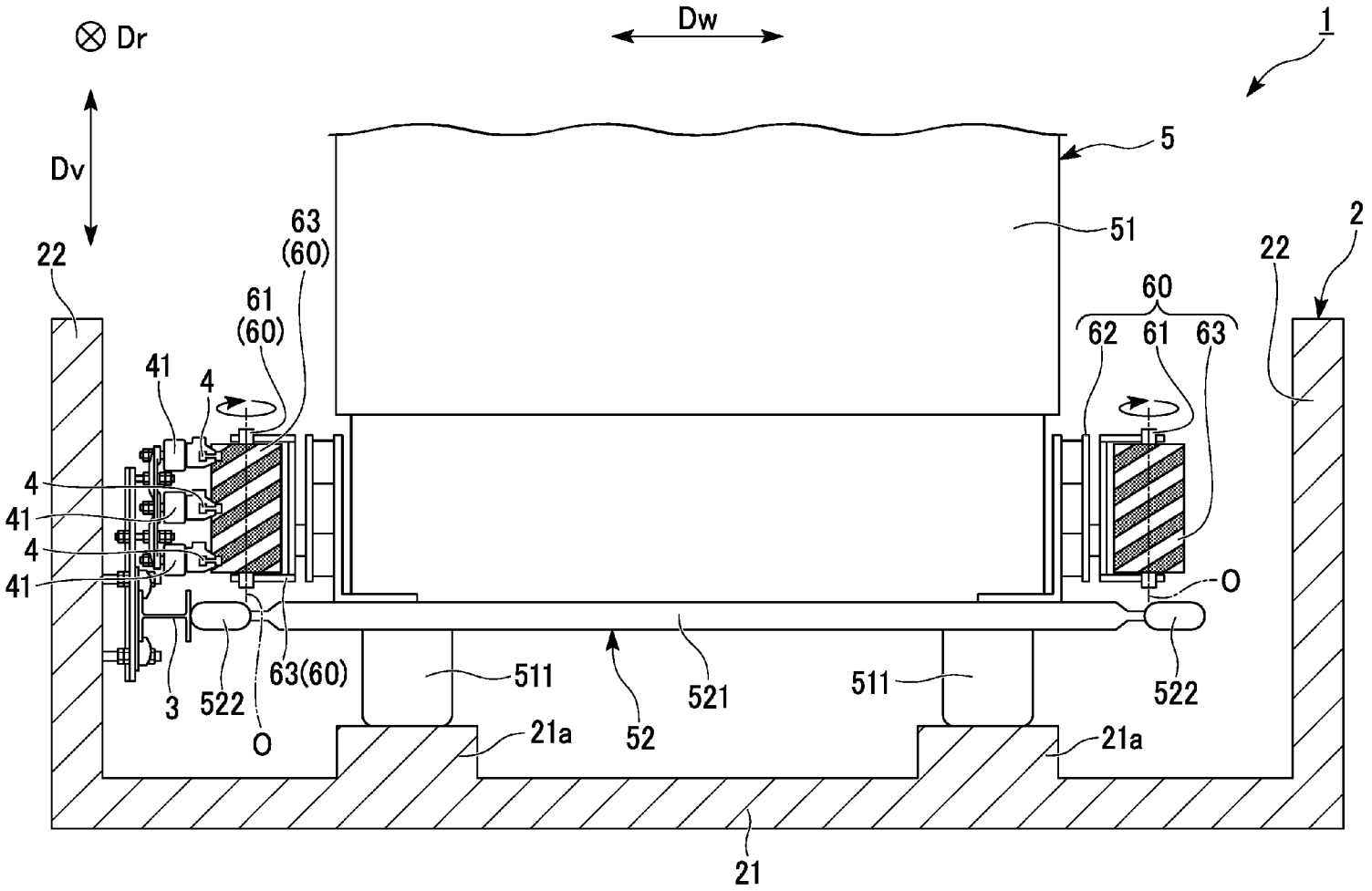
FIG. 2 is a schematic view showing a vehicle body on which a snow removal brush is mounted in an embodiment of the present invention.
Figure 3:
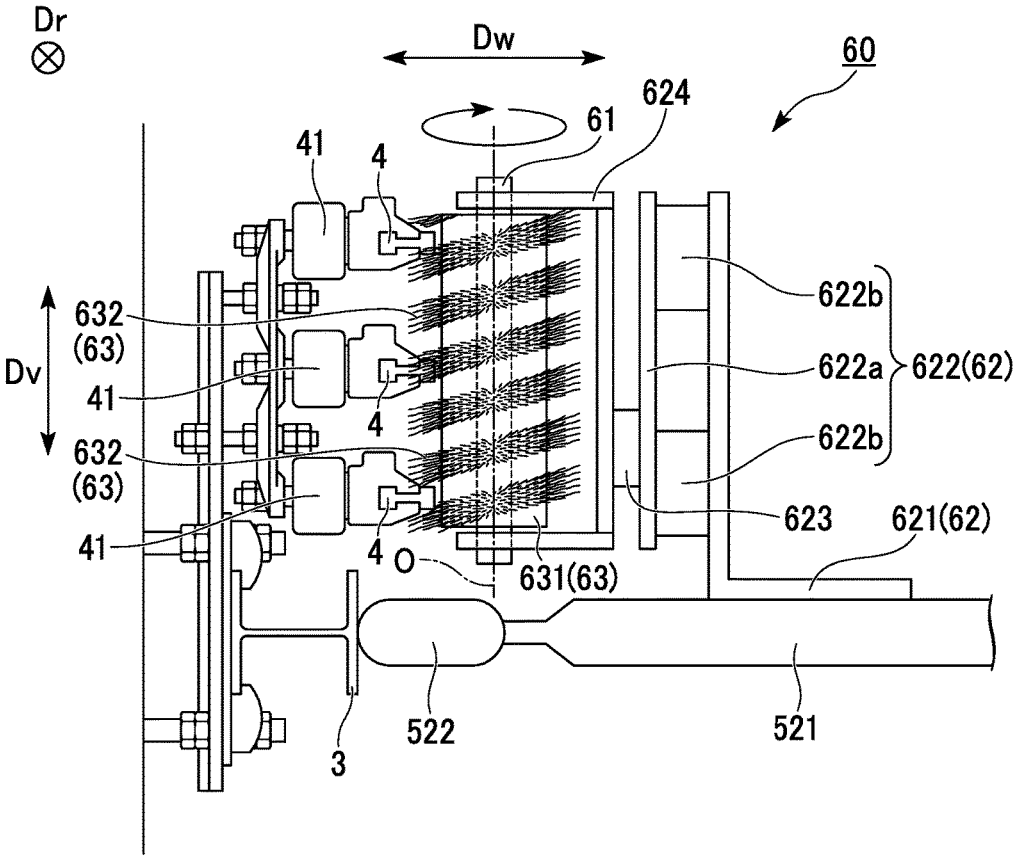
FIG. 3 is a schematic view showing a snow removal brush in a first embodiment of the present invention.

Hereinafter, a first embodiment of the present invention will be described with reference to FIGS. 1 to 3.

Figure 1:
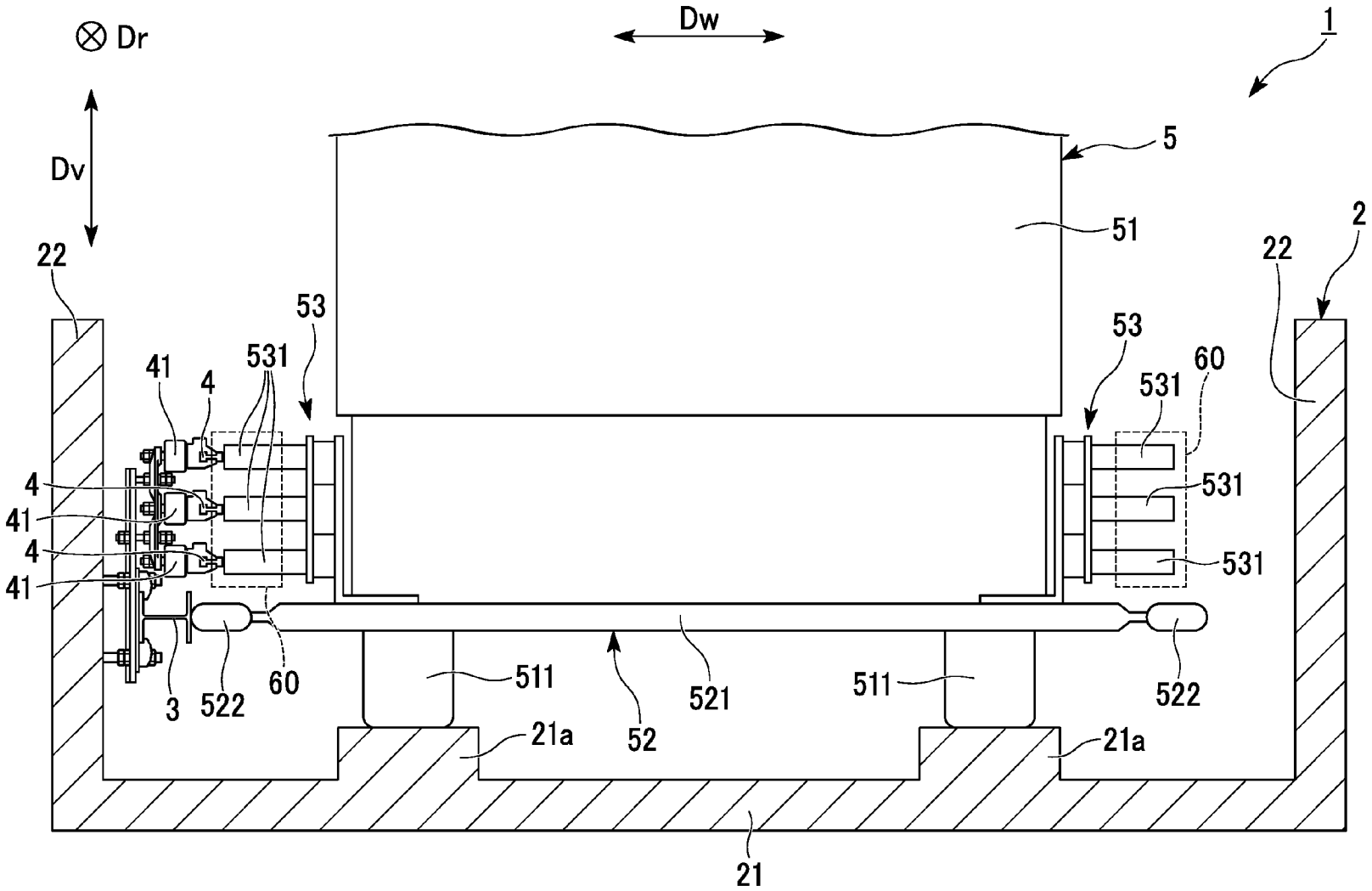
FIG. 1 is a schematic view showing a track transportation system in an embodiment of the present invention.

As shown in FIG. 1, a combination vehicle according to a first embodiment of the present invention is a combination vehicle of a track transportation system 1 that travels on a track 2 while being guided by guide rails 3 provided for the track 2. The track transportation system 1 of the present embodiment is a lateral guide rail type (side guide type) transportation system in which the guide rails 3 are provided at both sides of the track 2 in a width direction and extend in an extending direction of the track 2. In the present embodiment, a plurality of vehicles 5 is connected to each other to constitute the combination vehicle. The vehicles 5 of the present embodiment will be described using a central vehicle as an example rather than a foremost vehicle or a rearmost vehicle.

The track 2 extends along a predetermined service route, in which linear sections and curved sections are mixed as needed. The track 2 includes a track surface 21 that is nearly horizontally provided, and sidewalls 22 that extend upward from opposite ends of the track surface 21 in a vertical direction Dv. The track surface 21 and the sidewalls 22 are integrally built of, for instance, concrete.

Runways 21*a* along which the vehicle 5 travels are formed on the track surface 21. The runways 21*a* are separated in a horizontal direction to correspond to running wheels 511 of the vehicle 5 to be described below, and are formed at two places. The runways 21*a* are formed to protrude upward from the track surface 21 in the vertical direction Dv such that upper surfaces thereof provide overall flat surfaces on which the running wheels 511 can roll.

The sidewalls 22 are provided with the guide rails 3, and trolley wires 4 for supplying electricity to the vehicle 5.

The guide rails 3 are provide for the respective sidewalls 22 of the opposite sides of the track 2 over a total length of the track 2. The guide rails 3 are fixed to the sidewalls 22 along with the trolley wires 4. The guide rails 3 extend to the same height from the track surface 21 in a running direction Dr in which the vehicle 5 travels. Here, the running direction Dr of the vehicle 5 in the present embodiment is a depth direction of the sheet in FIG. 1.

The trolley wires 4 are lined up with the guide rails 3 in the vertical direction, and are provided for the sidewalls 22 over a total length of the track 2. Unlike the guide rails 3, the trolley wires 4 are provided for any one of the sidewalls 22 according to a disposed position. The trolley wires 4 are fixed to the sidewall 22 via insulators 41. Each of the insulators 41 is formed of a known insulating material, and dimensions and ratings thereof are appropriately selected depending on the design. The trolley wires 4 are fixed to leading ends of the insulators 41. Similar to the guide rails 3, the trolley wires 4 extend to the same heights from the track surface 21 in the running direction Dr of the vehicle 5. In the present embodiment, the three trolley wires 4 are disposed in parallel at predetermined intervals in the vertical direction Dv.

The vehicle 5 is equipped with a vehicle body 51 that travels on the track 2, a guide device 52 that guides the vehicle body 51 along the track 2, power collection devices 53 that are mounted on the vehicle body 51 and receive the electricity supplied from the trolley wires 4, and snow removal brushes 60 that are disposed on both lateral surfaces of the vehicle body 51 in a vehicle width direction Dw. The vehicle width direction Dw of the vehicle body 51 in the present embodiment is a leftward/rightward direction of the sheet in FIG. 1.

The vehicle body 51 has a structure which has a box shape in an exterior view and in which a cavity is present. The vehicle body 51 is provided with an opening/closing door and windows (not shown) at a lateral portion thereof, and a pair of left and right running wheels 511 at a bottom portion thereof. The power collection devices 53 receive the electricity, and thereby the running wheels 511 are driven and rotated by a power-driven part (not shown). As the running wheels 511, for instance, rubber tires are used. The running wheels 511 move forward on the runways 21*a* while being rotated, and thereby the vehicle body 51 travels on the track 2.

The guide device 52 is equipped with a guide frame 521 that is provided at a lower side of the vehicle body 51, and guide wheels 522 that are rotatably supported by the guide frame 521.

The guide frame 521 extends in the vehicle width direction Dw. Opposite ends of the guide frame 521 are located outside the running wheels 511. The opposite ends of the guide frame 521 are provided with the respective guide wheels 522.

The guide wheels 522 are disposed outside the lateral surfaces of the vehicle body 51, and are supported by the guide frame 521 to be rotatable about their rotational axes in the vertical direction Dv. The guide wheels 522 are provided at approximately the same height as the guide rails 3. Therefore, when the vehicle 5 travels, the guide wheels 522 are rotated by coming into contact with the guide rails 3.

The power collection devices 53 are provided in parallel above the guide wheels 522 in the vertical direction Dv at the opposite sides of the vehicle body 51 in the vehicle width direction Dw. Each of the power collection devices 53 is provided with power collection parts 531 to correspond to the trolley wires 4. In the present embodiment, each of the power collection devices 53 has three power collection parts 531 on the lateral surface of the vehicle body 51 to correspond to the three trolley wires 4.

The power collection parts 531 are provided to protrude outward beyond the lateral surface of the vehicle body 51 in the vehicle width direction Dw. The power collection parts 531 are provided at approximately the same heights as the trolley wires 4. When the vehicle 5 travels, the power collection parts 531 come into contact with the trolley wires 4. The power collection parts 531 and the trolley wires 4 are both formed of a material having conductivity. Therefore, the power collection parts 531 and the trolley wires 4 come into contact with each other, and thereby the electricity flowing through the trolley wires 4 is supplied to the power collection parts 531. Power from this electricity is supplied to the power-driven part (not shown) of the vehicle body 51, and is used to drive the running wheels 511.

The snow removal brushes 60 remove snow on the trolley wires 4. As shown in FIG. 2, the snow removal brushes 60 are provided on both lateral surfaces of the vehicle body 51 in the vehicle width direction Dw. Each of the snow removal brushes 60 is disposed at a position at which it protrudes outward beyond the lateral surface of the vehicle body 51 in the vehicle width direction Dw. That is, as shown in FIG. 1, the snow removal brushes 60 are disposed in together with the power collection devices 53 at positions separated in the running direction Dr, and are disposed at positions overlapping the power collection device 53 when viewed in the running direction Dr. As shown in FIG. 3, each of the snow removal brushes 60 of the present embodiment has a brush rotary shaft 61 that rotates about an axis O extending in a direction intersecting the track surface 21, a rotary support part 62 that rotatably supports the brush rotary shaft 61 on the vehicle body 51, and a brush part 63 that protrudes from an outer circumferential surface of the brush rotary shaft 61 toward a radial outer side. The snow removal brushes 60 of the present embodiment are provided for the vehicle 5 disposed in the center.

The brush rotary shaft 61 is rotatably supported via the rotary support part 62 by the vehicle body 51. The brush rotary shaft 61 of the present embodiment has a columnar shape extending along the axis O extending in the vertical direction Dv that is the direction intersecting the track surface 21.

The rotary support part 62 supports the brush rotary shaft 61 to be rotatable about the axis O. The brush part 63 is disposed at a position at which the brush part 63 is in contact with the trolley wires 4 by the rotary support part 62. The rotary support part 62 of the present embodiment rotatably supports the brush rotary shaft 61 with respect to the guide frame 521 fixed to the vehicle body 51. To be specific, the rotary support part 62 of the present embodiment includes a bracket 621 mounted on the guide frame 521, an insulating part 622 mounted on the bracket 621, a fixing axle 623 mounted on the insulating part 622, and a backup part 624 mounted on the fixing axle 623.

The bracket 621 fixes the insulating part 622 to the guide frame 521. The bracket 621 of the present embodiment is a member in which a cross-sectional shape viewed in the running direction Dr is an L shape. In detail, the bracket 621 has a long side portion and a short side portion extending from an end of the long side portion in an orthogonal direction, and thereby has the L shape. In the bracket 621, the short side portion is disposed at a lower side in the vertical direction Dv than the long side portion. The bracket 621 is disposed such that the short side portion assumes a horizontal posture, and is fixed to an end of the guide frame 521.

The insulating part 622 is doubly insulated such that no short circuit occurs when the trolley wires 4 and the brush part 63 come into contact with each other. The insulating part 622 of the present embodiment has an insulating plate **622*a* and insulators 622*b* fixing the insulating plate 622*a* to the bracket 621**.

The insulating plate **622*a*** is a plate-like member formed of a material having an insulation property.

The insulators **622*b* are formed of the same materials as the insulators 41 used when the trolley wires 4** are fixed.

When a self-propelled maintenance vehicle such as an internal combustion railcar powered by an internal combustion engine or a battery vehicle operated by a battery is used as the vehicle 5 and disconnects power from the trolley wires 4 for work, the insulating part 622 may not be doubly insulated, or a structure in which the insulating part 622 itself is not present may be possible.

The fixing axle 623 fixes the insulating plate **622*a* and the backup part 624. The fixing axle 623 is disposed at a lower side than a center position of the brush rotary shaft 61 in the vertical direction Dv. To be specific, the fixing axle 623 of the present embodiment is disposed between the insulating plate 622*a* and the backup part 624 in the vehicle width direction Dw at lower sides of the insulating plate 622*a* and the backup part 624** in the vertical direction Dv.

The backup part 624 is fixed to the fixing axle 623, and rotatably supports the brush rotary shaft 61.

The backup part 624 of the present embodiment supports upper and lower sides of the brush rotary shaft 61 in the vertical direction Dv. The backup part 624 rotatably supports the brush rotary shaft 61 in any direction around the axis O. The backup part 624 has a C shape that is a cross-sectional shape viewed in the running direction Dr, and is open to an outer side in the horizontal direction and to front and rear sides in the running direction Dr.

The brush part 63 is fixed to the brush rotary shaft 61, and rotates along with the brush rotary shaft 61.

The brush part 63 has a brush fixing portion 631 fixed to the brush rotary shaft 61, and a brush part body 632 protruding from the brush fixing portion 631 toward a radial outer side.

The brush fixing portion 631 has a cylindrical shape. The brush fixing portion 631 is fixed to an outer circumferential surface of the brush rotary shaft 61 within the backup part 624 in a state in which the brush rotary shaft 61 is inserted therein. The brush fixing portion 631 has an outer shape in which an outer circumferential surface thereof is not in contact with the trolley wires 4. The brush fixing portion 631 may be formed of a metal material or an insulating material. To be specific, for the brush fixing portion 631 of the present embodiment, for instance, a ferrous metal or a non-ferrous metal (copper or aluminum) is an exemplary example of the metal material, and a fiber reinforced plastic (FRP) or vinyl chloride is an exemplary example of the insulating material.

The brush part body 632 is a brush-like member formed to protrude from the outer circumferential surface of the brush fixing portion 631. Here, the brush-like member includes a member in which, for instance, linear members each having, for example, a circular, elliptical, rectangular or polygonal external shape or cross-sectional shape and a diameter of 0.3 to 3.0 mm are bundled and fixedly buried in the brush fixing portion 631. The brush part body 632 is formed such that, upon coming into contact with the trolley wires 4, a tip portion thereof overlaps the trolley wires 4 across a predetermined width. In the present embodiment, the predetermined width is a width by which the tip portion can stably continue to be in contact with the trolley wires 4 without contact with the insulators 41. To be specific, the brush part body 632 is formed to overlap the trolley wires 4 across a width of about 30 mm to 50 mm as the predetermined width. The brush part body 632 is provided on a spiral region formed on the outer circumferential surface of the brush fixing portion 631 to be directed to an upper side in the vertical direction Dv which is one side in an axis O direction in which the axis O extends with the approach to one side in a circumferential direction of the brush rotary shaft 61. To be specific, the spiral region of the present embodiment is formed to be directed from a lower side to an upper side in the vertical direction Dv while the circumferential direction of the brush rotary shaft 61 is directed from the front to the rear in the running direction Dr. That is, the brush part body 632 protrudes from the outer circumferential surface of the brush rotary shaft 61 via the brush fixing portion 631 in a spiral shape. The brush part body 632 is formed of a material having an insulation property. To be specific, the brush part body 632 of the present embodiment is formed of, for instance, nylon or polypropylene (PP). Also, when provided for a maintenance vehicle that disconnects power from the trolley wires 4 and is self-propelled by, for instance, an internal combustion engine, the brush part body 632 may be a metal brush of wires or copper wires. Also, the brush part body 632 may be a brush derived from a plant such as bamboo or palm or a strip-shaped rubber plate.

Next, an operation of each snow removal brush 60 of the first embodiment will be described.

In the first embodiment, the power collection parts 531 of the power collection device 53 of the vehicle 5 come into contact with the trolley wires 4, and thereby electricity from the trolley wires 4 is supplied to the vehicle body 51. In the vehicle body 51, the electricity is supplied to a drive source (not shown), and the running wheels 511 are rotated. As the running wheels 511 are rotated, the vehicle body 51 travels on the runways 21*a* along the track 2 while bringing the guide wheel 522 into contact with the guide rail 3. As the vehicle body 51 travels on the runways 21*a*, the brush part 63 of the snow removal brush 60 that is brought into contact with the trolley wires 4 is rotated about the axis O. To be specific, in a state in which the brush part body 632 is brought into contact with the trolley wires 4, the vehicle body 51 moves in the running direction Dr, and thereby the brush part body 632 is pressed toward the rear in the running direction Dr. Thereby, the brush fixing portion 631 provided with the brush part body 632 is rotated about the axis O toward a rear side in the running direction Dr along with the brush rotary shaft 61. That is, as the vehicle body 51 travels, the snow removal brush 60 rotates the brush part body 632 to be directed from the front to the rear in the running direction Dr while bringing the brush part body 632 into contact with the trolley wires 4.

According to the snow removal brush 60 as described above, the vehicle body 51 travels on the runways 21*a* formed on the track surface 21. Thereby, the brush part bodies 632 provided on the opposite lateral surfaces of the vehicle body 51 in the vehicle width direction Dw come into contact with the trolley wires 4, and allow the brush rotary shafts 61 to be rotated about the axis O extending in the vertical direction Dv toward the rear in the running direction Dr. For this reason, even when snow accumulates on the trolley wires 4 from snowfall, the brush part bodies 632 protruding from the brush fixing portions 631 fixed to the brush rotary shafts 61 to a radial outer side can be rotated about the axis O to brush away the snow on the trolley wires 4 while coming into contact with the trolley wires 4. Thereby, the snow that has accumulated on the trolley wires 4 extending along the track 2 can be easily removed merely by the vehicle body 51 traveling on the runways 21*a*.

Also, if the snow accumulates on the trolley wires 4, the power collection parts 531 of the power collection device 53 and the trolley wires 4 are in an insulated state on contact surfaces, and there is a possibility of sparking. If sparking occurs, electric wear is accelerated, and there is a possibility of abnormal wear occurring at the power collection parts 531. Further, when the snow that has accumulated on the trolley wires 4 is left and thereby, the accumulated snow will thaw and form icicles, there is a risk of the trolley wires 4 lined up in the vertical direction Dv connecting and short circuiting. However, the snow on the trolley wires 4 can be brushed away by the brush part bodies 632 merely by the vehicle body 51 traveling on the runways 21*a*, and therefore it is possible to prevent such problems in advance.

Also, each of the brush rotary shafts 61 is rotated about the axis O that extends in the vertical direction Dv that is the direction intersecting the track surface 21 of the track 2. Thereby, it is possible to simultaneously remove the snow that has accumulated on the plurality of trolley wires 4 lined up in the vertical direction Dv.

Also, the brush part bodies 632 are brought into contact with the trolley wires 4 by the brush rotary shafts 61 while being rotated. Thereby, only a part of the brush part body 632 provided on the outer circumferential surface of the brush fixing portion 631 in the circumferential direction can be inhibited from coming into contact with the trolley wires 4. For this reason, the amount of wear of the brush part body 632 can be uniform in the circumferential direction, and a life of the brush part body 632 can be prolonged.

Also, the brush part bodies 632 are formed on the outer circumferential surfaces of the brush fixing portions 631 in the spiral shape. Thereby, it is possible to bring the brush part bodies 632 into oblique contact with the trolley wires 4 extending to the same heights from the track surface 21 in the running direction Dr. For this reason, when the vehicle body 51 travels and the brush rotary shafts 61 are rotated, the snow that has accumulated on the trolley wires 4 can be brushed away to be scraped off by the brush part bodies 632. Thereby, it is possible to efficiently remove the snow that has accumulated on the trolley wires 4.

In addition, the vehicle 5 equipped with the snow removal brushes 60 as described above is connected to the other vehicles. Thereby, it is possible to limit the occurrence of power cut in which the electricity supplied to the vehicle body 51 from the trolley wires 4 via the power collection parts 531 is stopped due to abnormal wear or a short circuit of the power collection parts 531. For this reason, it is possible to prevent service disruption or train delay caused by the power cut.

Second Embodiment

Figure 4:
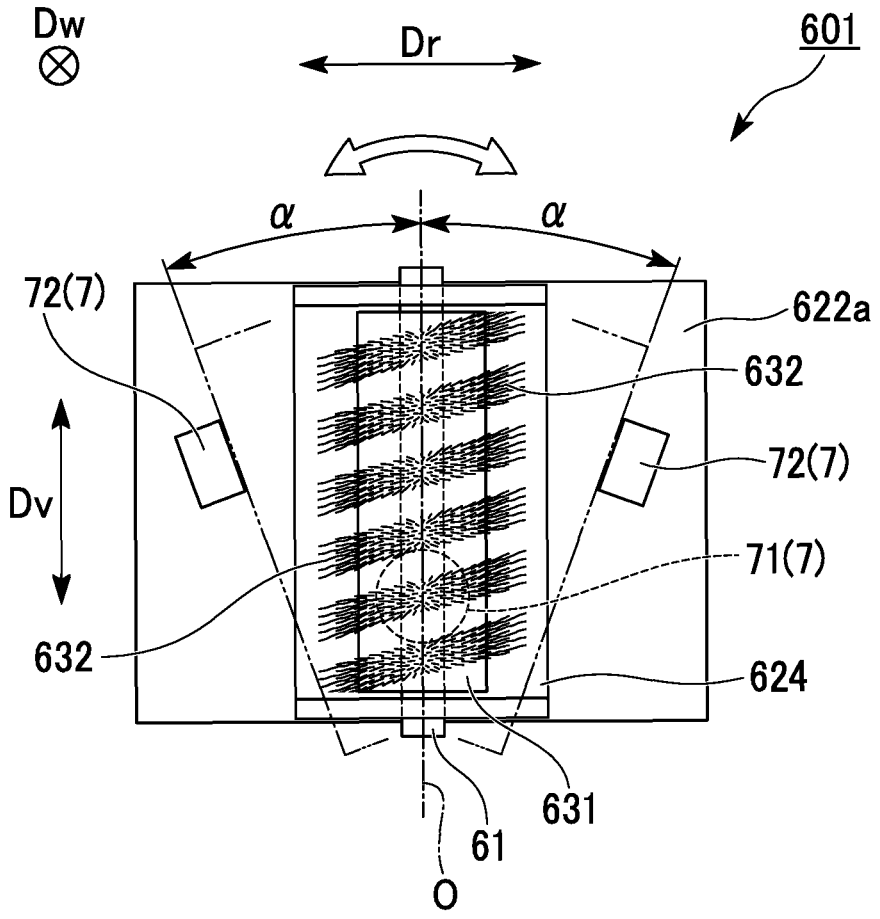
FIG. 4 is a schematic view showing a snow removal brush in a second embodiment of the present invention.

Next, a snow removal brush 601 of a second embodiment will be described with reference to FIG. 4.

In the second embodiment, the same components as in the first embodiment are given the same symbols, and detailed description thereof will be omitted. The snow removal brush 601 of the second embodiment is different from that of the first embodiment in that it has a structure for oscillating a brush rotary shaft 61 in a running direction Dr.

The snow removal brush 601 of the second embodiment is equipped with an oscillation part 7 that obliquely oscillates the brush rotary shaft 61 over a predetermined range in the running direction Dr. The oscillation part 7 of the present embodiment includes an oscillation support portion 71 that oscillatably supports the brush rotary shaft 61 via a backup part 624, and oscillation stoppers 72 that restrict an oscillation range within which the brush rotary shaft 61 oscillates.

In a state in which a brush part body 632 is in contact with trolley wires 4, the oscillation support portion 71 supports the brush rotary shaft 61 to oscillate along a surface orthogonal to a track surface 21. In the present embodiment, the surface orthogonal to the track surface 21 is parallel with lateral surfaces of a vehicle body 51, and is a virtual surface that extends from the track surface 21 in a vertical direction Dv. The oscillation support portion 71 of the present embodiment supports the backup part 624 instead of the fixing axle 623 of the first embodiment. To be specific, the oscillation support portion 71 of the present embodiment is a columnar member that is disposed at the same position as the fixing axle 623 of the first embodiment and is rotatably supported with respect to an insulating plate 622*a*. The oscillation support portion 71 of the present embodiment oscillates using the oscillation support portion 71 itself as an axis of rotation to incline the backup part 624 toward a front side or a rear side in the running direction Dr. That is, the oscillation support portion 71 supports the brush rotary shaft 61 via the backup part 624 to oscillate with respect to the insulating part 622.

The oscillation stoppers 72 restrict an oscillation range of the brush rotary shaft 61 to oscillate within a predetermined range. The oscillation stoppers 72 of the present embodiment restrict an oblique angle $\alpha$ of the backup part 624 oscillated by the oscillation support portion 71. The oscillation stoppers 72 of the present embodiment restrict the oblique angle $\alpha$ of the backup part 624 to be inclined forward and backward at angles of about 10° to 15° in the running direction Dr. To be specific, the oscillation stoppers 72 of the present embodiment are provided to protrude from an outer surface of the insulating plate 622*a* in a vehicle width direction Dw. The oscillation stoppers 72 are provided in the front and rear of the insulating plate 622*a* in the running direction Dr to sandwich the brush rotary shaft 61 in the center therebetween when viewed from outside in the vehicle width direction Dw. That is, the oscillation stoppers 72 are in contact with lateral surfaces of the backup part 624 which are directed in the running direction Dr, and thereby restrict the oblique angle $\alpha$ of the backup part 624.

Next, an operation of the snow removal brush 601 of the second embodiment will be described.

According to the snow removal brush 601 of the second embodiment, the vehicle body 51 travels on runways 21*a*, and the brush part body 632 comes into contact with the trolley wires 4. In this state, when the brush part body 632 is pressed backward in the running direction Dr, the backup part 624 is inclined backward in the running direction Dr using the oscillation support portion 71 as a starting point. The inclined backup part 624 comes into contact with the oscillation stopper 72 provided in the rear of the backup part 624 in the running direction Dr. In the state in which the backup part 624 is in contact with the oscillation stopper 72, the vehicle body 51 further travels, and thereby the brush part body 632 is pressed backward in the running direction Dr while coming into contact with the trolley wires 4. Thereby, a brush fixing portion 631 provided with the brush part body 632 is rotated about an axis O toward the rear in the running direction Dr along with the brush rotary shaft 61. That is, the vehicle body 51 travels, and thereby the snow removal brush 601 rotates the brush part body 632 to be directed from the front to the rear in the running direction Dr along with the brush rotary shaft 61 while bringing the brush part body 632 into oblique contact with the trolley wires 4.

According to the snow removal brush 601 as described above, the oscillation support portion 71 supports the backup part 624 to be able to oscillate forward and backward in the running direction Dr with respect to the insulating plate 622*a* fixed to the vehicle body 51, and thereby supports the brush rotary shaft 61 to be able to oscillate with respect to the insulating plate 622*a*.

For this reason, the vehicle body 51 merely travels, and thereby the brush rotary shaft 61 can be inclined with high precision along with the backup part 624. The brush rotary shaft 61 can be inclined with high precision in association with the traveling of the vehicle body 51. Thereby, the brush part body 632 can be obliquely inclined with respect to the trolley wires 4, and brought into contact with the trolley wires 4. As a result, the brush part body 632 formed in a spiral shape can be rotated while being brought into contact with the trolley wires 4 in a state in which it is more obliquely inclined with respect to the trolley wires 4, and snow that has accumulated on the trolley wires 4 can be more efficiently scraped and brushed away. Thereby, the snow that has accumulated on the trolley wires 4 can be easily removed in a more efficient way.

Also, the oscillation stoppers 72 are provided at positions at which the oblique angle $\alpha$ of the backup part 624 is restricted forward and backward in the running direction Dr. For this reason, the brush rotary shaft 61 can be stably inclined at a predetermined angle $\alpha$. Thereby, it is possible to bring the brush part body 632 into oblique contact with the trolley wires 4 at an angle at which the snow that has accumulated on the trolley wires 4 is easily scraped off.

Also, the oscillation stoppers 72 are provided in the front and rear in the running direction Dr with the brush rotary shaft 61 located in the center therebetween. For this reason, even when the running direction Dr of the vehicle body 51 is changed by a shuttle service, the brush rotary shaft 61 can be stably inclined with high precision along the backup part 624 regardless of the running direction Dr.

In addition, the oscillation support portion 71 is disposed at a position at which it deviates downward relative to the center position of the brush rotary shaft 61 in the vertical direction Dv in the same way as the fixing axle 623 of the first embodiment. Thereby, a weak force is merely provided to the brush part body 632 in the running direction Dr, and thereby the brush rotary shaft 61 can be easily inclined.

Unlike the present embodiment, the oscillation support portion 71 may be disposed at a position at which it deviates upward relative to the center position of the brush rotary shaft 61 in the vertical direction Dv. As the oscillation support portion 71 is disposed at such a position, the brush rotary shaft 61 can be returned to a position at which the axis O extends in the vertical direction Dv under its own weight at a position at which no trolley wires 4 are present. Thereby, the brush rotary shaft 61 can be stably held.

In addition, the oscillation support portion 71 is not limited to a structure for oscillating the brush rotary shaft 61 by oscillatably supporting the backup part 624, and may have a structure capable of oscillating the brush rotary shaft 61. For example, the oscillation support portion 71 may oscillatably support the brush rotary shaft 61 itself, or may support the entire snow removal brush 601 to be able to oscillate with respect to the vehicle body 51.

Third Embodiment

Figure 5:
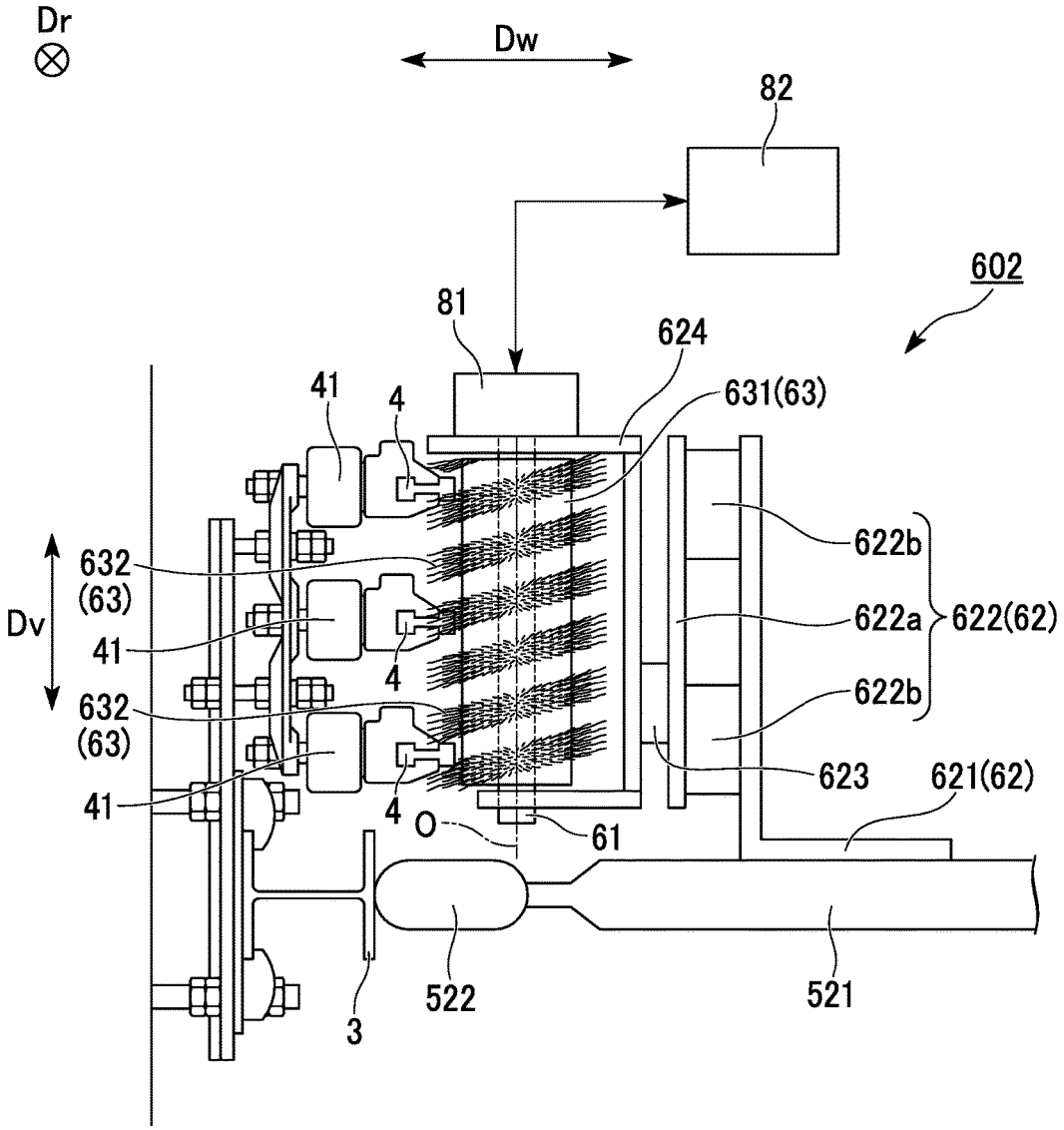
FIG. 5 is a schematic view showing a snow removal brush in a third embodiment of the present invention.

Next, a snow removal brush 602 of a third embodiment will be described with reference to FIG. 5.

In the third embodiment, the same components as in the first or second embodiment are given the same symbols, and detailed description thereof will be omitted. The snow removal brush 602 of the third embodiment is different from that of the first or second embodiment in that it has a structure configured to rotate a brush rotary shaft 61 while controlling the brush rotary shaft 61.

The snow removal brush 602 of the third embodiment not only freely rotates the brush rotary shaft 61 but also rotates the brush rotary shaft 61 by supplying power from the outside. The snow removal brush 602 of the third embodiment is equipped with a rotation drive part 81 that rotates and drives the brush rotary shaft 61 about an axis O, and a rotation control part 82 that adjusts and controls rotation of the brush rotary shaft 61 rotated by the rotation drive part 81.

The rotation drive part 81 rotates the brush rotary shaft 61 even in a state in which a brush part body 632 of a brush part 63 is not in contact with trolley wires 4. The rotation drive part 81 of the present embodiment independently rotates the brush rotary shaft 61 regardless of a traveling state of a vehicle body 51. The rotation drive part 81 of the present embodiment is a motor that is disposed at an upper side of a backup part 624 in a vertical direction Dv and is connected to the brush rotary shaft 61. The rotation drive part 81 rotates the brush rotary shaft 61 based on a signal from the rotation control part 82.

The rotation control part 82 sends a signal to the rotation drive part 81, and thereby changes a speed and direction of rotation of the brush rotary shaft 61. When the trolley wires 4 and the brush part body 632 come into contact with each other, the rotation control part 82 of the present embodiment sends a signal for rotating the brush rotary shaft 61 to the rotation drive part 81 such that the brush rotary shaft 61 is directed from the front to the rear of the vehicle body 51 in a running direction Dr, or sends a signal for rotating the brush rotary shaft 61 to the rotation drive part 81 such that the brush rotary shaft 61 is reversely directed from the rear to the front in the running direction Dr. That is, the rotation control part 82 sends a signal for switching the direction of rotation to the rotation drive part 81. The rotation control part 82 sends a signal to the rotation drive part 81 to assume an arbitrary speed of rotation. The rotation control part 82 of the present embodiment is provided for a cab (not shown) of the vehicle body 51, and is operated along with traveling of the vehicle body 51 by a driver who drives the vehicle body 51. To be specific, the rotation control part 82 may also make it possible to adjust the speed of rotation of the brush rotary shaft 61 to become a speed faster than a speed of rotation of the brush rotary shaft 61 rotated by itself as the vehicle body 51 in the first or second embodiment travels, and the trolley wires 4 and the brush part body 632 come into contact with each other.

Next, an operation of the snow removal brush 602 of the third embodiment will be described.

According to the snow removal brush 602 of the third embodiment, the signal is sent from the rotation control part 82 to the rotation drive part 81 regardless of the traveling state of the vehicle body 51, and thereby the brush rotary shaft 61 is rotated.

To be specific, when the trolley wires 4 and the brush part body 632 come into contact with each other, the rotation control part 82 of the third embodiment sends a signal for switching the direction of rotation to the rotation drive part 81 such that the brush rotary shaft 61 is rotated from the front toward the rear of the vehicle body 51 in the running direction Dr. Also, the rotation control part 82 sends a signal for adjusting the speed of rotation of the brush rotary shaft 61 to the rotation drive part 81 such that the brush rotary shaft 61 is rotated at a faster speed of rotation than a speed at which the brush rotary shaft 61 is rotated by itself as the trolley wires 4 and the brush part body 632 come into contact with each other. The rotation drive part 81 rotates the brush rotary shaft 61 at the speed of rotation and in the direction of rotation based on the signal. In a state in which the brush rotary shaft 61 is rotated by the rotation drive part 81, the vehicle body 51 travels, and thereby the brush part body 632 comes into contact with the trolley wires 4 while being rotated.

According to the snow removal brush 602 as described above, the brush rotary shaft 61 is rotated by the rotation drive part 81. Thereby, the brush rotary shaft 61 can be stably rotated regardless of a traveling speed or operating situation of the vehicle body 51. For this reason, it is possible to bring the brush part body 632 into contact with the trolley wires 4 while stably maintaining the rotating state. Thereby, snow that has accumulated on the trolley wires 4 can be stably removed.

Also, the direction and speed of rotation of the brush rotary shaft 61 rotated by the rotation drive part 81 are adjusted by the rotation control part 82. Thereby, it is possible to rotate the brush rotary shaft 61 depending on a kind or amount of falling snow. For this reason, it is possible to adequately bring the brush part body 632 into contact with the trolley wires 4 depending on the kind or amount of the snow. Therefore, the snow that has accumulated on the trolley wires 4 can be even more efficiently removed.

Also, the signal is sent to the rotation drive part 81 by the rotation control part 82 such that the speed of rotation of the brush rotary shaft 61 becomes a speed faster than the speed of rotation of the brush rotary shaft 61 rotated by itself as the vehicle body 51 travels and the trolley wires 4 and the brush part body 632 come into contact with each other. Thereby, it is possible to rotate the brush part body 632 at a high speed to come in contact with the trolley wires 4. For this reason, it is possible to improve an effect of brushing away the snow that has accumulated on the trolley wires 4 using the brush part body 632.

In addition, the direction of rotation of the brush rotary shaft 61 can be adjusted by the rotation control part 82. Thereby, it is possible to rotate the brush rotary shaft 61 about the axis O to be directed from the front toward the rear of the vehicle body 51 in the running direction Dr opposite to the running direction Dr of the vehicle body 51. For this reason, when needed depending on the kind or amount of the snow, the brush part body 632 can be rotated in the opposite direction and be brought into contact with the trolley wires 4. Therefore, it is possible to improve an effect of brushing away the snow that has accumulated on the trolley wires 4 using the brush part body 632.

The snow removal brush 602 is not limited to a structure in which, as in the third embodiment, the rotation drive part 81 and the rotation control part 82 are combined and provided. The snow removal brush 602 may have a structure with only the rotation drive part 81.

Also, the rotation drive part 81 is not limited to a structure in which, as in the present embodiment, it is provided at the upper side of the brush rotary shaft 61. The rotation drive part 81 may be mounted at a lower side of the brush rotary shaft 61 or in the brush rotary shaft 61 itself.

Also, the rotation drive part 81 is not limited to the motor as in the present embodiment, and need only be able to rotate the brush rotary shaft 61. For example, the rotation drive part 81 may be a pneumatic motor or a hydraulic motor, or may have a structure configured to transmit power of the vehicle body 51 to the brush rotary shaft 61. The structure configured to transmit power of the vehicle body 51 to the brush rotary shaft 61 may be, for instance, a roller chain or a V belt. Further, when the structure configured to transmit power of the vehicle body 51 to the brush rotary shaft 61 is used, the rotation drive part 81 may have a structure configured to interpose a speed changer configured by adjusting a gear ratio between them to thereby rotate the brush rotary shaft 61 at a high speed.

In addition, the rotation control part 82 is not limited to adjusting and controlling both the speed and direction of rotation as in the present embodiment, and need only be able to adjust and control at least one of the speed and direction of rotation. For example, the rotation control part 82 may adjust and control only the speed of rotation or only the direction of rotation.

Although embodiments of the present invention have been described above in detail with reference to the drawings, the constitutions and combinations in these embodiments are mere example, and additions, omissions, substitutions, and other modifications of the constitution are possible without departing from the spirit of the present invention. Also, the present invention is not limited by the above description, and is only limited by the claims.

The snow removal brushes 60, 601, or 602 are not limited to being provided for the vehicle 5 disposed at the midpoint of the combination vehicle as in each of the aforementioned embodiments, but may be provided for any one of the plurality of vehicles. For example, the snow removal brushes 60, 601, or 602 may be provided for a foremost or rearmost vehicle of the combination vehicle. The snow removal brushes 60, 601, or 602 provided on the left and right in the vehicle width direction Dw may be provided for different vehicles.

In addition, each of the brush part bodies 632 of the present embodiment need only be formed of an insulating material, and is not limited to being in a brush shape. For example, the brush part body 632 may be formed in a flat plate shape and protrude from the brush fixing portion 631 in a spiral shape.

What is claimed is:

1. A snow removal brush comprising:

a brush rotary shaft disposed on each of opposite lateral surfaces of a vehicle body traveling along a track and in a vehicle width direction of the vehicle body and supported by the vehicle body to be rotatable about an axis extending in a direction intersecting a track surface of the track; and a brush part configured to protrude from an outer circumferential surface of the brush rotary shaft to a radial outer side, wherein the brush part is formed to come into contact with trolley wires provided for the track and supplying electricity to the vehicle body.

2. The snow removal brush according to claim 1, wherein the brush part is provided on a spiral region formed on the outer circumferential surface of the brush rotary shaft to be directed to one side in an axis direction in which the axis extends with the approach to one side in the circumferential direction of the brush rotary shaft.

3. The snow removal brush according to claim 1 further comprising an oscillation support portion that oscillatably supports the brush rotary shaft in a running direction in which the vehicle body travels in a state in which the brush part is in contact with the trolley wires.

4. The snow removal brush according to claim 2 further comprising an oscillation support portion that oscillatably supports the brush rotary shaft in a running direction in which the vehicle body travels in a state in which the brush part is in contact with the trolley wires.

5. The snow removal brush according to claim 1 further comprising a rotation drive part that rotates and drives the brush rotary shaft about the axis.

6. The snow removal brush according to claim 2 further comprising a rotation drive part that rotates and drives the brush rotary shaft about the axis.

7. The snow removal brush according to claim 3 further comprising a rotation drive part that rotates and drives the brush rotary shaft about the axis.

8. The snow removal brush according to claim 4 further comprising a rotation drive part that rotates and drives the brush rotary shaft about the axis.

9. The snow removal brush according to claim 5 further comprising a rotation control part that adjusts and controls rotation of the brush rotary shaft rotated by the rotation drive part.

10. The snow removal brush according to claim 6 further comprising a rotation control part that adjusts and controls rotation of the brush rotary shaft rotated by the rotation drive part.

11. The snow removal brush according to claim 7 further comprising a rotation control part that adjusts and controls rotation of the brush rotary shaft rotated by the rotation drive part.

12. The snow removal brush according to claim 8 further comprising a rotation control part that adjusts and controls rotation of the brush rotary shaft rotated by the rotation drive part.

13. The snow removal brush according to claim 9 further comprising a rotation control part that adjusts and controls rotation of the brush rotary shaft rotated by the rotation drive part.

14. A vehicle comprising the snow removal brush according to claim 1.

15. A combination vehicle connected to comprise at least one of the vehicles according to claim 14.

16. A track transportation system comprising:

the vehicle according to claim 14; and the track which has the trolley wires and along which the vehicle body of the vehicle travels.

* * * * *